United States Patent [19]

Armer, Jr. et al.

[11] Patent Number: 4,684,137

[45] Date of Patent: Aug. 4, 1987

[54] SIMULATED WAR GAME WEAPON

[76] Inventors: Leon N. Armer, Jr., 22 Utica St., Brockport, N.Y. 14420; Joseph M. Antonio, 151 Rosecroft Dr.; Craig A. Roth, 241 Haviland Pk., both of Rochester, N.Y. 14616; James R. VerWeire, 48 Ogden Ctr. Rd., Spencerport, N.Y. 14559

[21] Appl. No.: 773,442

[22] Filed: Sep. 6, 1985

[51] Int. Cl.[4] ..... A63B 71/02

[52] U.S. Cl. ..... 273/428; 102/513; 273/363; 273/418

[58] Field of Search ..... 273/428, 418, 58 B, 273/58 F, 58 H, 363; 102/502, 512, 513, 498

[56] References Cited

U.S. PATENT DOCUMENTS

| | | | |
|---|---|---|---|
| 3,156,187 | 11/1964 | Batou | 102/498 X |
| 3,419,274 | 12/1968 | Tabor | 273/418 |
| 3,791,303 | 2/1974 | Sweeney et al. | 102/502 |
| 4,212,460 | 7/1980 | Kraft | 273/428 X |
| 4,240,396 | 12/1980 | Randoll | 273/428 X |

*Primary Examiner*—Paul E. Shapiro

*Attorney, Agent, or Firm*—Lawrence P. Kessler

[57] ABSTRACT

A weapon for use in simulated war games, such weapon being particularly usable in situations where targets or opposing pesonnel are out of a direct line of sight or where weapon use in a conventional manner would be otherwise dangerous and should be avoided. Such weapon includes a frangible chamber and a slurry contained within such chamber. The slurry contains a dispersing agent and a plurality of particles serving as a marking agent. Further, a storage container is provided for receiving the slurry-containing frangible chamber to protect the chamber from accidental rupture. In use, the slurry-containing chamber is removed from the container and delivered toward the target by being manually tossed in an arcuate path to strike a target or the vicinity thereof. On striking such target, or its vicinity, the frangible chamber ruptures and the dispersing agent disperses the marking particles against such target thereby identifying the target as being eliminated from the game. As such the weapon emulates a manually deliverable grenade.

5 Claims, 4 Drawing Figures

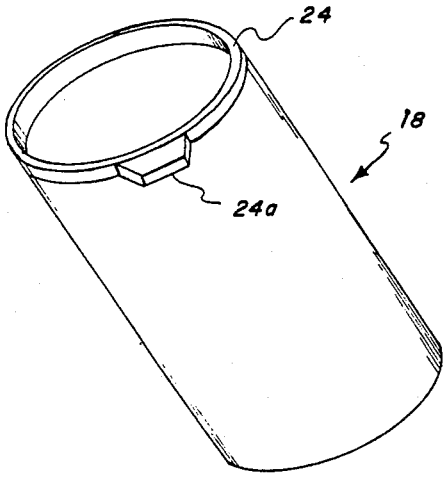
FIG. 2
FIG. 1
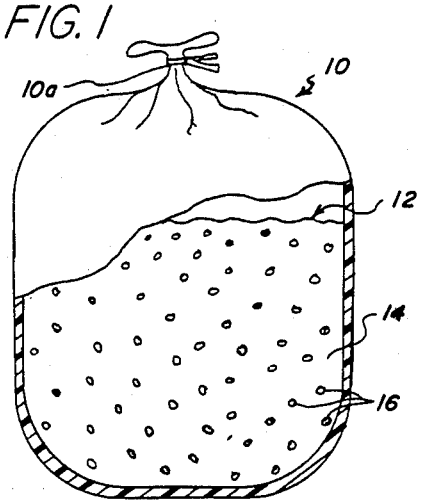
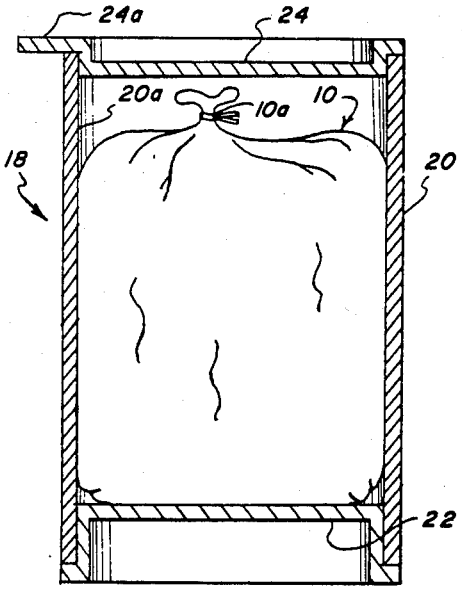
FIG. 3

SIMULATED WAR GAME WEAPON

BACKGROUND OF THE INVENTION

This invention relates generally to a weapon for use in simulated war games, and more particularly to a war game weapon emulating a grenade.

Simulated war games have long been used for the purpose of training military personnel in the use of weapons and strategic combat tactics. Recently, however, simulated war games have become a popular recreational outlet for non-military personnel. Such games are played with weapons that utilize a colorant or paint container for example. The colorant is directed by the weapon against a target such as opposing personnel. When the colorant strikes the target or such opposing personnel that target or person is identified by the colorant as being eliminated from the game.

Simulated war game weapons in use today are typically air guns which propel the colorant in a substantially straight line trajectory. Therefore, such weapons are not useful for eliminating targets or opposing personnel who are out of a direct line of sight. Further, under circumstances where only the head of any opposing personnel is visible as a target, the use of such weapons may present a real danger and is generally avoided.

SUMMARY OF THE INVENTION

This invention is directed to a weapon for use in simulated war games, such weapon being particularly usable in situations where targets or opposing personnel are out of a direct line of sight or where weapon use in a conventional manner would be otherwise dangerous and should be avoided. Such weapon includes a frangible chamber and a slurry contained within such chamber. The slurry contains a dispersing agent and a plurality of particles serving as a marking agent. Further, a storage container is provided for receiving the slurry-containing frangible chamber to protect the chamber from accidental rupture. In use, the slurry-containing chamber is removed from the container and delivered toward the target by being manually tossed in an arcuate path to strike a target or the vicinity thereof. On striking such target, or its vicinity, the frangiable chamber ruptures and the dispersing agent disperses the marking particles against such target thereby identifying the target as being eliminated from the game. As such the weapon emulates a manually deliverable grenade.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 1 is a side elevational view, partly in cross-section, of a slurry-containing frangiable chamber for a simulated war game weapon according to this invention;

FIG. 2 is a view, in perspective, of a container for the slurry-containing frangiable chamber of FIG. 1;

FIG. 3 is a side elevational view, partly in cross-section, of the slurry-containing chamber and container for a simulated war game weapon according to this invention.

DESCRIPTION OF THE PREFERRED EMBODIMENT

Figure 4:
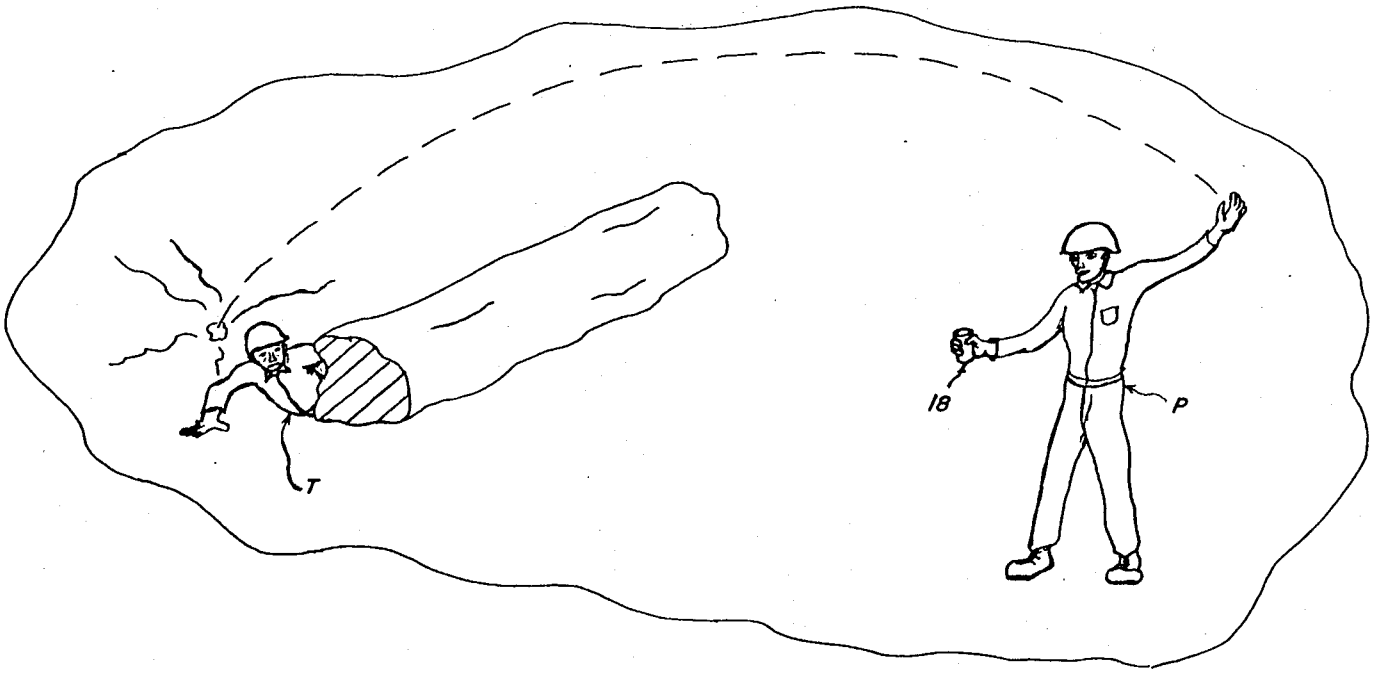
FIG. 4 is a view, in perspective, showing the use of the simulated war game weapon according to the invention.

Referring now to the accompanying drawings, FIGS. 1 through 3 show the structure for a simulated war game weapon according to this invention. The weapon is adapted to emulate, in function and use, a manually deliverable grenade. Such weapon is adapted to emulate, in function and use, a manually deliverable grenade. Such weapon includes a frangiable chamber 10, such as an inflatable balloon for example. The chamber 10 is filled with a slurry 12 (see FIG. 1) and tied at its neck portion 10*a* to retain the slurry within the chamber. The slurry 12 includes a dispersing agent 14 and marking agent 16. When the chamber is filled with the slurry, it expands thereby reducing its wall thickness to the point where the wall will readily rupture on impact with, or in the vicinity of, a target. On rupture, the dispersing agent disperses the marking agent against the target. Since the slurry-containing chamber is easily ruptured, a container 18, more fully described hereinbelow, is provided to facilitate carrying of the weapon and to prevent accidental rupture of the chamber.

The purpose of the weapon according to this invention is for use in a simulated war game against targets which are out of a direct line of sight or where weapon use in a conventional manner would be otherwise dangerous. The targets may be either property or opposing personnel. Due to the nature of the targets, it is desirable that the dispersing agent 14, and the marking agent 16, be non-toxic, washable, and biodegradeable. Accordingly, the dispersing agent comprises a combination of water and rockdust in a ratio by weight of approximately 1 to 1; and the marking agent 16 is a plurality of particles such as paper confetti. As such, the dispersing and marking agents readily meets the desired criteria of non-toxibility, washability and biodegradeableness.

The container 18, for facilitating carrying and preventing accidental rupture of the slurry-containing chamber 10, includes a cylindrical tube 20 (see FIGS. 2 and 3). The tube 20 is formed of substantially rigid material, such as cardboard or tin, for example, and is permanently sealed at one end with a cap 22. The opposite end of the tube is selectively closed by a removable cap 24. The cap 24 is, for example, press fit into the tube to close the tube and has a tab portion 24*a* to enable the cap to be readily removed from the tube. With the cap 24 removed, the slurry-containing chamber 10 is receivable into, or withdrawable from, the interior of the tube 20. The exterior surface of the chamber 10 or interior wall 20*a* of the tube is desirably coated with a lubricating substance to facilitate relative movement between the chamber and the tube when the chamber is inserted into or withdrawn from the tube. Such substance is, for example, talcum powder. Of course, other lubricants such as a silicone spray are suitable for use with this invention. When the slurry-containing chamber 10 is received in the tube 20 and cap 24 is in place, the chamber is protected by the container 18 from accidental or premature rupture. Further, the container 18 enables the chamber 10 to be readily carried by a participant in a simulated war game, such as for example by carrying the container in a pouch or attaching the container to a belt worn by such participant.

The use of the weapon according to this invention in a simulated war game is shown in FIG. 4. In such Fig., a participant in the simulated war game is designated by the letter P and the opponent or target is designated by the letter T. While the target T is shown and described as being an opposing personnel, such target could as well be a physical structure such as a building or base camp. When such participant P sights an opponent T and such opponent is not in a direct line of sight or in a position to be safely eliminated by other conventional war game weapons, the participant employs the weapon according to this invention as follows: The cap 24 of the container 18 is removed from the tube 20 and the slurry-containing frangiable chamber 10 is withdrawn. The participant P manually tosses the chamber 10 with a lob motion in an arcuate path toward the opponent T or the vicinity of such opponent. When the frangiable chamber 10 strikes the opponent or the vicinity thereof, the chamber ruptures and the marking agent particles are dispersed by the dispersing agent in a pattern toward or against the opponent. The opponent T is then identified as being eliminated from the game. The above described weapon according to this invention thus emulates a manually deliverable grenade in function and use.

The invention has been described in detail with particular reference to a preferred embodiment thereof, but it will be understood that variations and modifications can be effected within the spirit and scope of the invention.

We claim:

1. A weapon for use in a simulated war game, said weapon comprising:

an inflatable ballon defining a frangible chamber; and a slurry contained within said chamber, said slurry including a non-toxic, washable, biodegradable dispersing agent comprising water and rock dust, and plurality of particles of paper confetti serving as a marking agent, whereby when said chamber is ruptured, said dispersing agent disperses said marking particles toward a target.

2. The invention of claim 1 further including a storage container adapted to receive and protect said slurry-containing frangiable chamber from accidental rupture.

3. A weapon emulating a grenade, for use in a simulated war game, said weapon comprising:

a marking agent;

means for suspending said marking agent for ready dispersion, said suspending means including a non-toxic washable, biodegradable combination of water and rock dust;

a readily frangible ballon containing said suspending means and said marking agent whereby, when said balloon is delivered like a grenade to strike a target, said balloon ruptures and said suspending means disperses said marking agent against said target; and a container adapted to receive said balloon and protect said balloon from accidental rupture.

4. The invention of claim 3 further including means for facilitating insertion and removal of said balloon from said container.

5. The invention of claim 4 wherein said means facilitating insertion and removal of said balloon from said container includes talcum powder applied to the outer surface of said balloon.

* * * * *